US005529173A

United States Patent [19]

Salacuse

[11] Patent Number: 5,529,173

[45] Date of Patent: Jun. 25, 1996

[54] CONVERTIBLE CONTAINER AND FRAME

[76] Inventor: Frank Salacuse, 50 E. 89th St., New York, N.Y. 10128

[21] Appl. No.: 119,016

[22] Filed: Sep. 9, 1993

[51] Int. Cl.[6] ..... B65D 81/36

[52] U.S. Cl. ..... 206/749; 40/779; 206/1.7; 206/315.1

[58] Field of Search ..... 40/152.1, 152, 40/154, 155; 206/1.7–1.9, 223, 315.1, 579, 564, 44 R, 44 B; 220/339, 4.22; 273/157 R

[56] References Cited

U.S. PATENT DOCUMENTS

| | | | |
|---|---|---|---|
| 1,941,558 | 1/1934 | Labbe | 273/157 R |
| 2,512,957 | 6/1950 | McCargo | 40/154 |
| 3,741,548 | 6/1973 | Kaupp | 40/152 |
| 4,140,317 | 2/1979 | Ramney | 273/157 R |
| 4,294,558 | 10/1981 | Errichiello | 220/339 |
| 4,486,018 | 12/1984 | Keller, Jr. | 273/157 R |
| 4,555,290 | 11/1985 | Graetz et al. | 206/564 |
| 4,781,384 | 11/1988 | Bois | 206/315.1 |
| 4,811,954 | 3/1989 | Hemmann | 206/315.1 |
| 4,865,325 | 9/1989 | Stolz | 273/157 R |

FOREIGN PATENT DOCUMENTS

| | | | |
|---|---|---|---|
| 0033918 | 8/1981 | European Pat. Off. | 273/285 |
| 01312961 | 1/1985 | European Pat. Off. | 40/155 |
| 0375925 | 7/1990 | European Pat. Off. | 220/4.22 |
| 1311848 | 3/1973 | United Kingdom | 220/339 |
| 2229709 | 10/1990 | United Kingdom | 220/339 |

*Primary Examiner*—Jimmy G. Foster
*Attorney, Agent, or Firm*—Paul J. Sutton; Barry G. Magidoff

[57] ABSTRACT

A convertible container having two panels hingedly connected to one another along single edges. Recessed interior walls permit the storage of items therein when the panels are closed. A raised ridge along three outer sides of the panels allows an item to be supported and framed within the exterior panels when the container is open and converted to a double length framed area. Various locks keep the panels closed, interior baffles keep items in place when the container is closed and hook devices permit the container to be displayed.

7 Claims, 8 Drawing Sheets

CONVERTIBLE CONTAINER AND FRAME

This invention relates to containers which can be converted into a frame which, in turn, can be reconverted back into a container. More particularly, this invention relates to containers which can be converted into frames suitable for framing the contents of said containers. Examples of said contents include jigsaw puzzles, art paper and colorants for drawing a picture, and a backdrop for mounting a montage of clippings, as well as the clippings themselves.

One of the growing problems facing society today is the issue of waste management. Containers which can be reused or recycled do not enter into the pool of waste for disposal. Reusable containers are more advantageous than recyclable containers because no added expenditure must be made to manufacture another product.

An object of this invention is that the containers herein described are suitable for shipping and storage of the container's contents and the tools needed to work with the container's contents. An optional thermoformed blister, or other auxiliary container, containing, e.g., a pair of scissors for cutting out, and a tube of glue for mounting, the clip art enclosed in the container, can be formed into, mounted onto, or inserted through, e.g., a die cut window in, the surface of the container. Objects such as stars and half-moons used to highlight the framed artwork can be included in either the main portion of the container or in the thermoformed blister pack.

A further object of this invention is to eliminate waste.

Other objects and advantages of this invention are clear from the description set forth herein.

The multiple use product of this invention, i.e. a box which can be used for either shipping or for storage, and which can be converted into a frame, provides the additional advantage of convenience to the consumer.

This invention can be manufactured by a variety of known methods, including thermoforming and/or pressure forming, stamping, or die cutting, from a single sheet, or roll, of a polymeric material, and then folding to the desired shape, or by casting or injection molding of polymer resins. Other materials and manufacturing procedures, such as cutting and folding sheets of paperboard can also be utilized. Folding a die cut sheet, can create a frame having a border with a square, triangular, or other configuration cross-section. These means of manufacture would both limit waste and allow variety of design.

Figure 1:
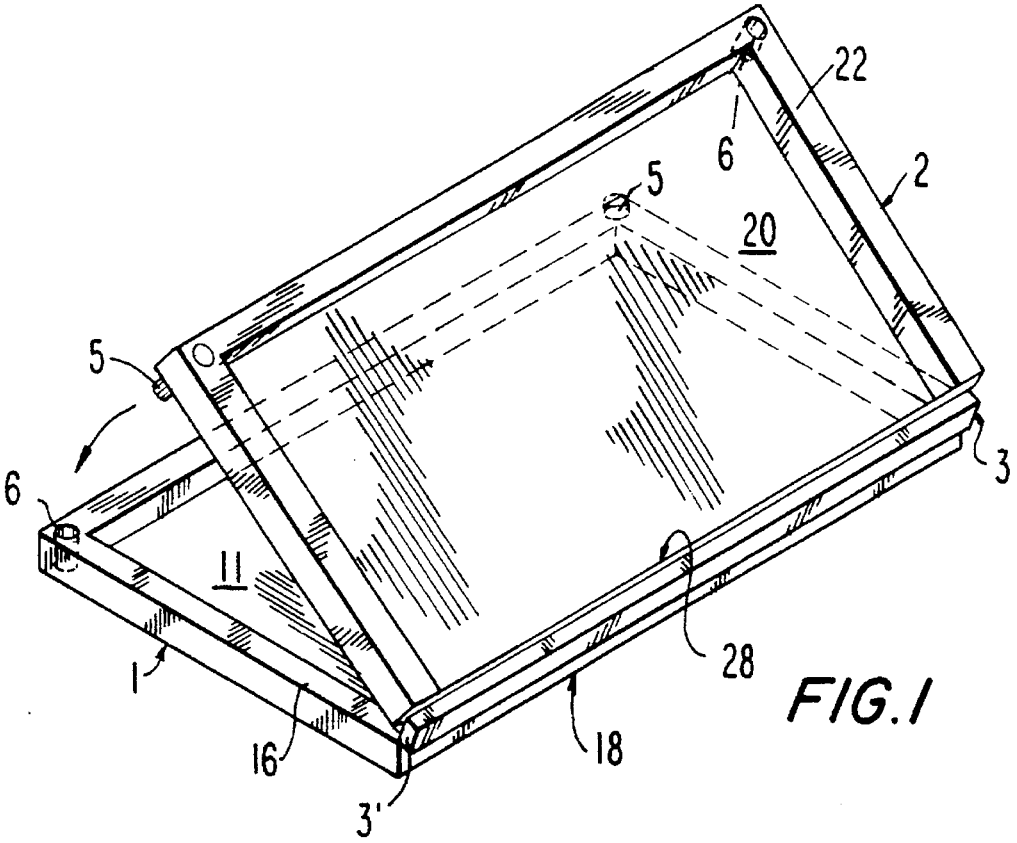
FIG. 1 is a view of a box in accordance with the present invention in an intermediate, partly folded, position.
Figure 2:
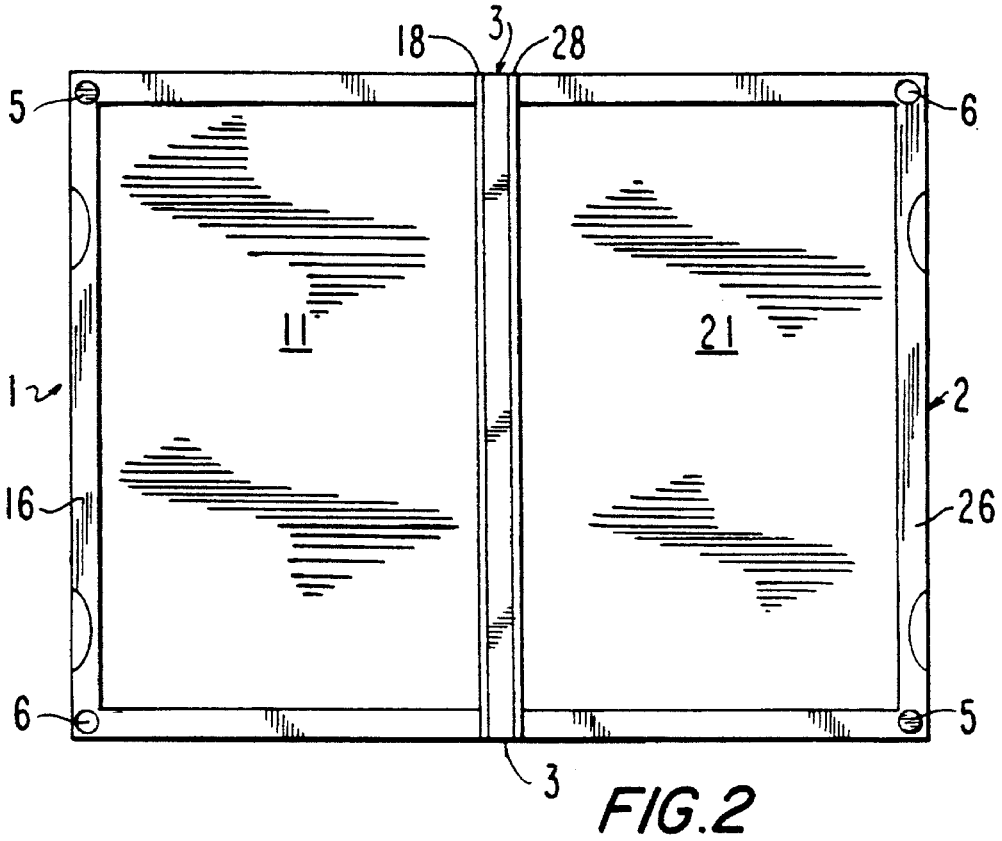
FIG. 2 is a plan view of the inner surface of the box of FIG. 1 in its unfolded position.
Figure 3:
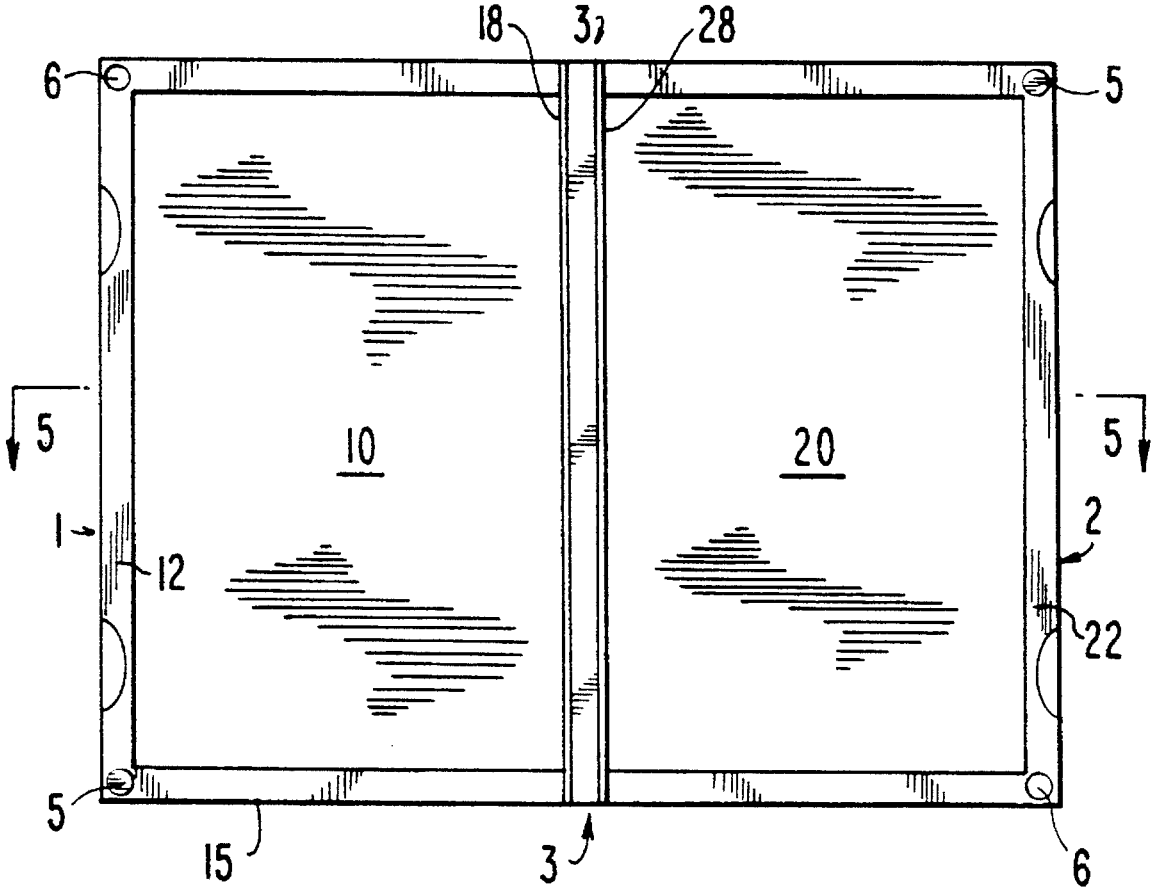
FIG. 3 is a plan view of the outer surface of the box of FIG. 1 in its unfolded position.

Referring to the drawings of FIGS. 1–5, the container of this embodiment is formed as an integral unit, which can be molded or cast, to form a foldable integral unit comprising two covers 1,2, interconnected by an integral hinge 3. The two covers can be locked together in the folded position by a pair of locking mechanisms (formed for example, by being molded or pressure formed), each mechanism being formed of a male portion, or plug 5, and a female portion, or socket 6.

The first cover 1 foldably connects to the integral hinge 3 along the first hinge fold 18 and the second cover 2 foldably connects to the integral hinge 3 along the second hinge fold 28.

Figure 4:
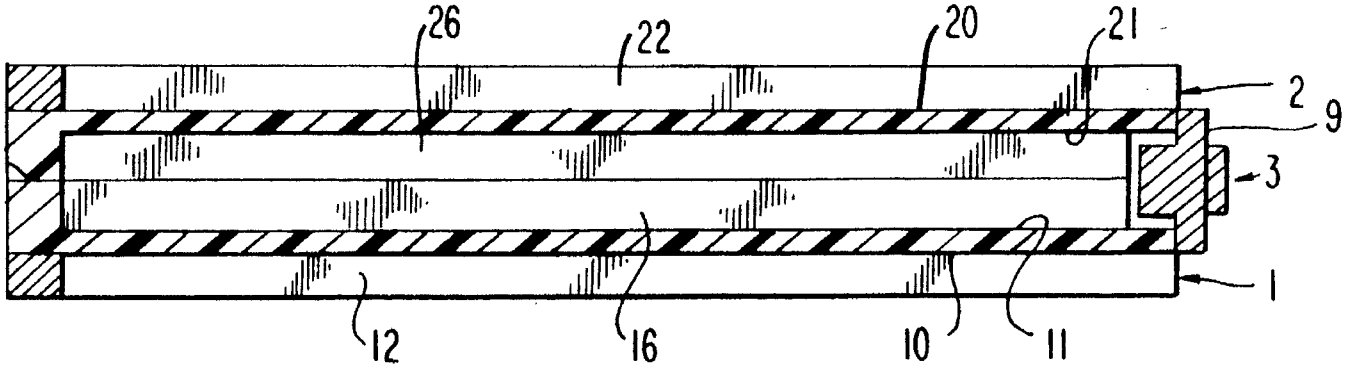
FIG. 4 is a cross-section of the embodiment shown in FIG. 1 in its folded position.
Figure 5:
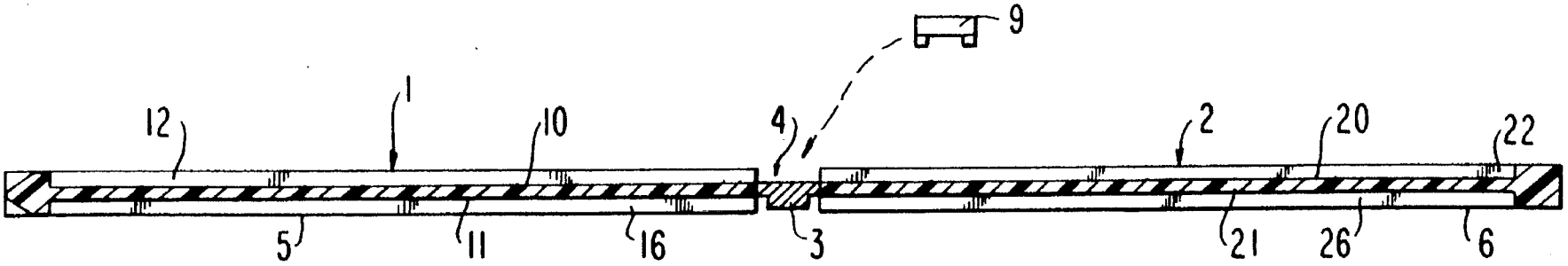
FIG. 5 is a cross section taken along lines 5—5 of FIG. 3.
Figure 6:
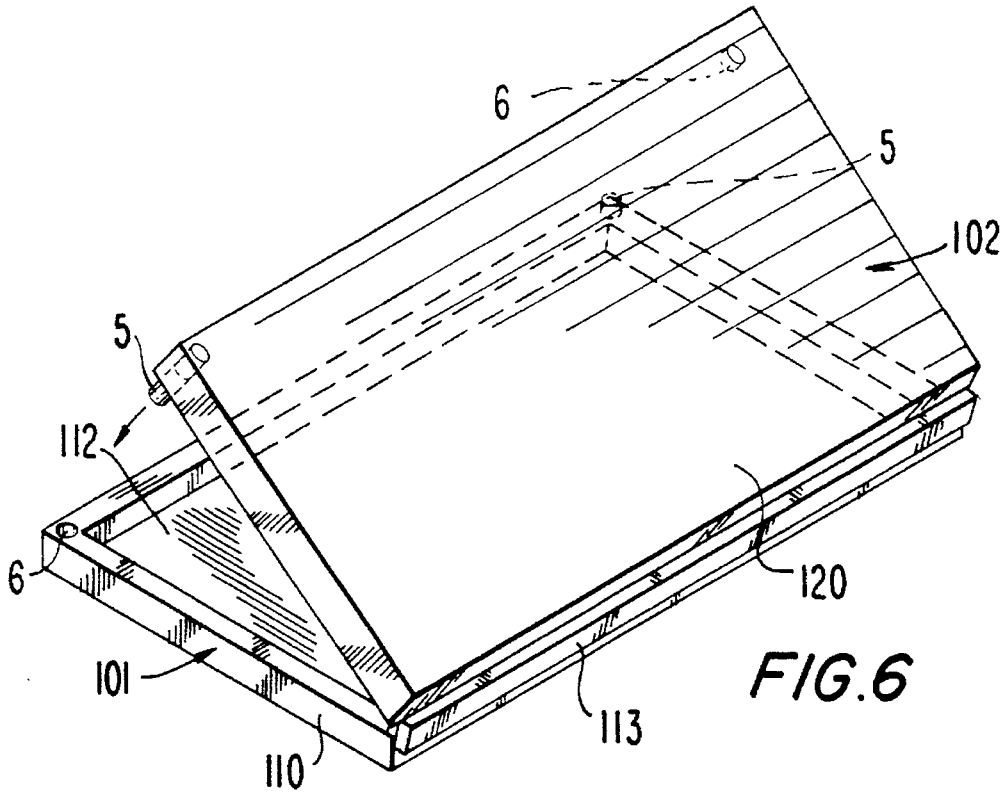
FIG. 6 illustrates another embodiment of the invention as in FIG. 1 with a framing border on the inner surface.
Figure 7:
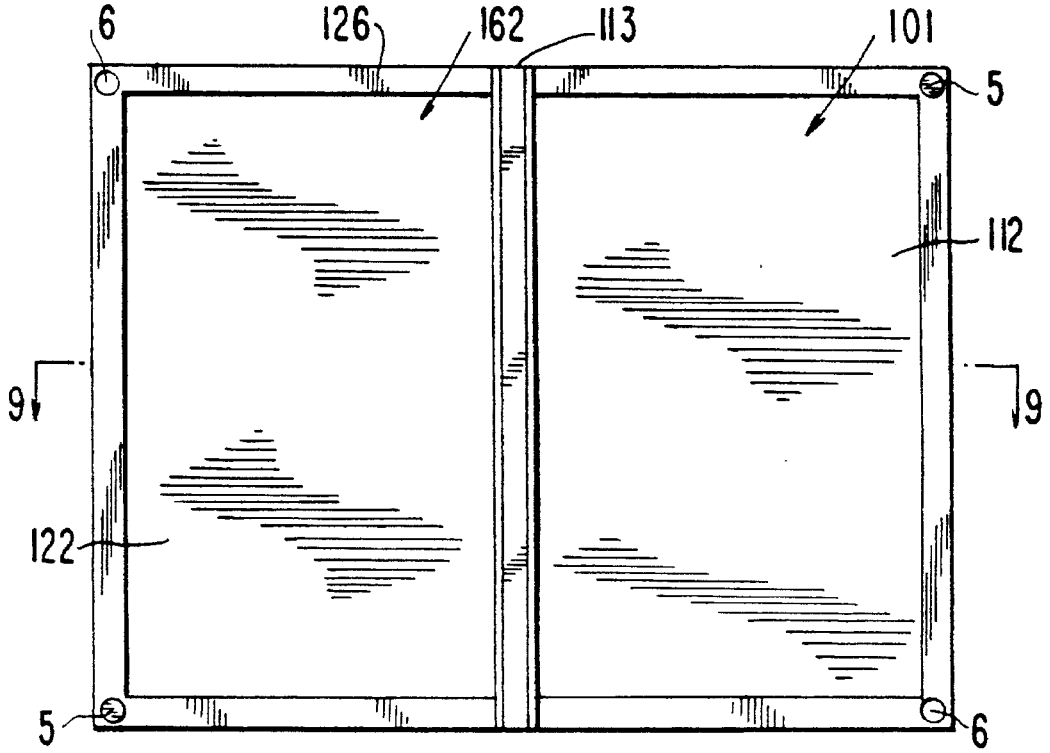
FIG. 7 is a plan view of the inner surface of the box of FIG. 6 in its unfolded position.
Figure 8:
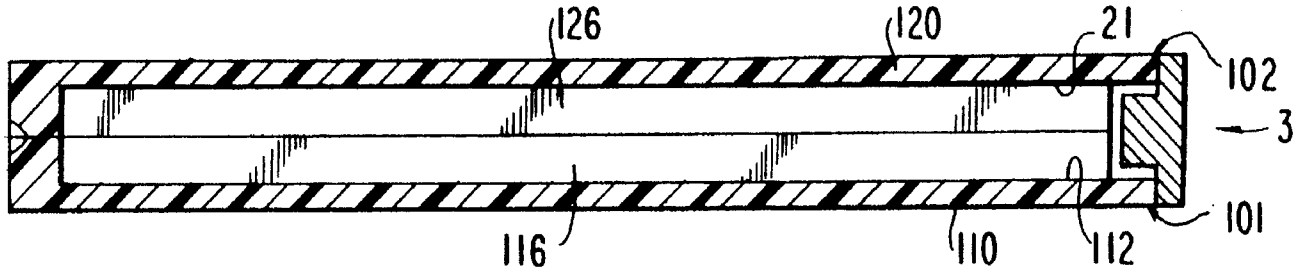
FIG. 8 is a cross-section of the embodiment shown in FIG. 6 in its folded position.
Figure 9:
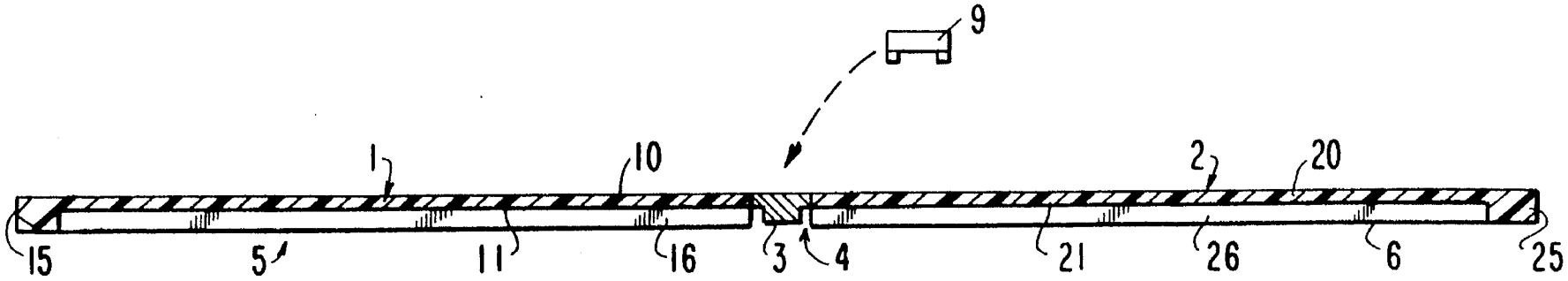
FIG. 9 is a cross section taken along lines 9—9 of FIG. 7, with an adapter plug to fill any discontinuity in the frame border.

In the fully unfolded position, (see FIG. 3) the mat, or support surface, for the frame comprises the outer surfaces 10 and 20 of the two covers 1and 2, respectively and the intermediate hinge portion 3. The framing border 12 extends outwardly from the outer surface 10 of cover 1, as best seen in FIG. 4 and the framing border 22 extends outwardly from the outer surface 20 of cover 2, as best seen in FIG. 4. The framing borders 12 and 22 can have any surface design or decoration, and any cross-sectional shape.

A first inner flange 16 extends inwardly from the inner surface 11 of cover 1 and a second inner flange 26 extends inwardly from the inner surface 21 of cover 2.

When the covers are folded together about the hinge 3, the inner flange 16 comes in contact with the opposing inner flange 26 to define a three-dimensional space inside the container, formed by closure of the covers 1 and 2. Said space is enclosed by the inner surfaces of the hinge 3, the two covers 1 and 2 and the inner flanges 16, 26 as best seen in FIG.4. The space in the outer periphery of the covers by hinge 3 can be filled if desired by a plug 9.

Figure 17:
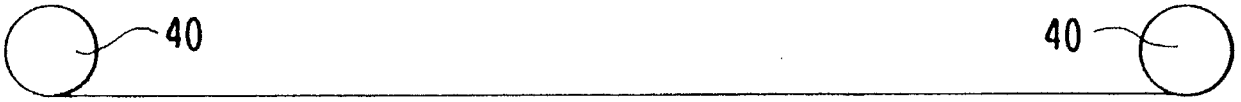
FIG. 17 shows a cross-section view of another embodiment of this invention, showing a rolled flange border.
Figure 14:
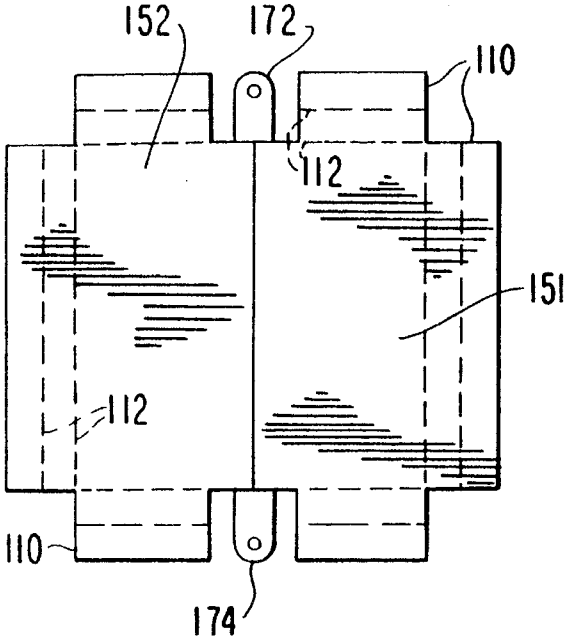
FIG. 14 depicts a sheet blank scored and cut to be folded into an embodiment of the present invention.

In the embodiment as illustrated in FIGS. 6–9, the outer surfaces of the two covers 101,102 have no raised framing border. This embodiment can be prepared by cutting a sheet blank, as is shown in FIG. 14, and folding the tabs 110 along the score lines 112 (shown in dashed lines), and sealing the folded tabs to the inner surface of the sheet to form an internal flange border 116 and 126. The flat sheet can be die-cut according to standard procedures commonly used in the art. Similarly, the fold lines can be formed by scoring or by cut-scoring, as is also well-known in use for the different types of sheet plastics that can be used. When forming the fold lines, often an addition glue flap (not shown) is provided to aid in maintaining the desired shape. The folds can be formed by machines well-known to the art, or manually. Alternatively, the flange border can be formed by pressure forming the single sheet of film to form the inwardly extending flanges 116 and 126, and a corresponding indentation on the outer surfaces of the covers 101,102. Such flange borders can also be formed into other shapes, including of rectangular cross-section or circular cross-section as by rolling the flaps 40 over, instead of folding along distinct fold lines, see FIG. 17.

For the outer framing border as well as the inner flange surfaces 116,126 there can be provide different superficial, e.g., imprinted designs, or a variety of cross-sectional shapes; the major purpose of the inwardly extending flange surfaces is to protect the product within the container.

Figure 11:
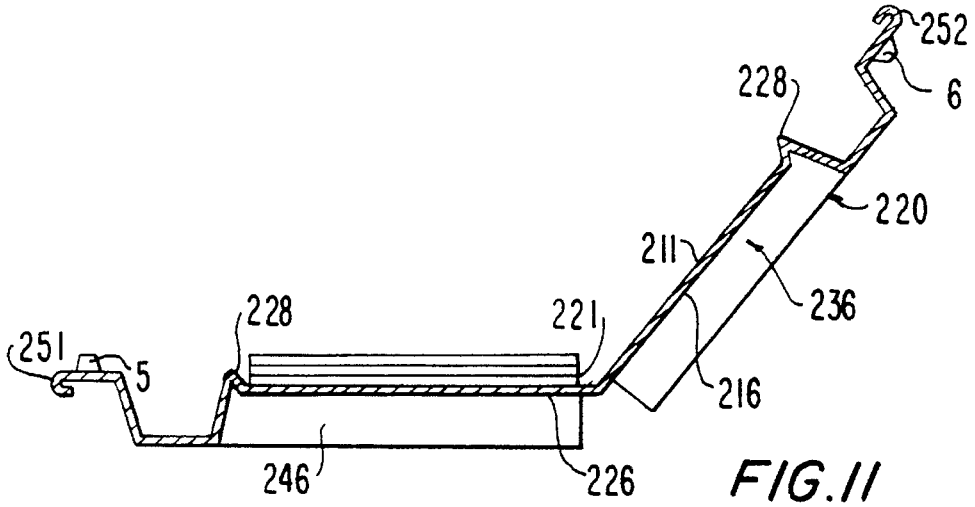
FIG. 11 is a cross-section of the container of FIG. 10 in the partially open position.
Figure 10:
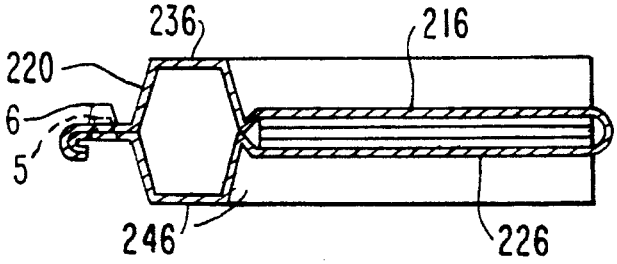
FIG. 10 illustrates an embodiment of the container of the present invention with no raised internal flanges.
Figure 12:
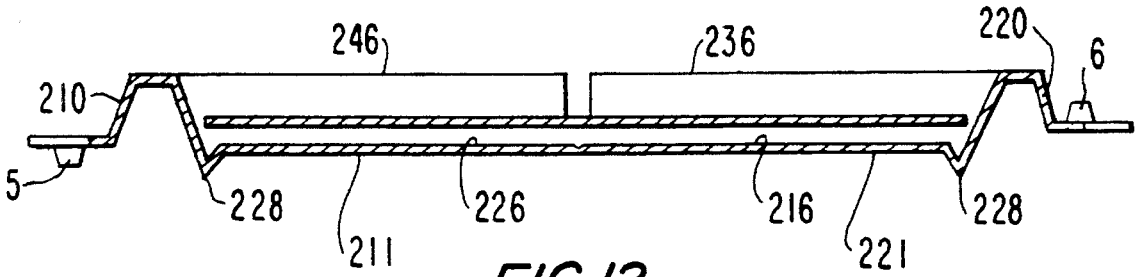
FIG. 12 is a cross-section of the embodiment shown in FIG. 10 in the fully open position and inverted.

In the embodiment illustrated in FIGS. 10–12, there are no inwardly extending flanges on the inner surfaces 211 and 221 of the covers 210 and 221, respectively; this embodiment is especially adapted for containing flat sheet materials, such as drawing paper, or the like. A slight depression to hold the flat sheets, is defined by the bumps 228 formed adjacent the framing borders 236,246. In this embodiment, only the outer cover surfaces 216,226, are surrounded on three sides by a series of framing borders 236 and 246 respectively.

In the embodiment of FIGS. 10–12, the integral hinge preferably does not have a single relatively wide center section, as in FIGS. 1–9, but can be simply formed of one or more closely spaced parallel folds or a single cut. For thicker stacks of sheets, at least two parallel hinge folds, and even more preferably, three such parallel folds, are provided to insure smooth folding, without wrinkling of the covers. Such folds are effectively formed by using cut-score lines, or even by cutting through along, e.g., up to about 90% of, the length of the hinge line, to ease folding, especially for heavier more rigid sheet material.

As a further feature, there are provided hanger means 251,252, extending from, preferably the center of, the edges of the two covers 210 and 220, respectively. Preferably, these hanger means are formed integral with the container and are intended to enable the container to hang on a display rack.

The framing borders on the containers of this invention need not run parallel or perpendicular to the hinge surface and can be rectangular, as illustrated, or of any two dimensional or even three dimensional shape, e.g., a curved mat surface, thus adding variety in design and functionality.

The container can be held in its closed position by any suitable locking or holding means, such as with plugs 5 and sockets 6, as shown in the drawings, by other interlocking means, such as providing undercuts in one cover to snap, e.g., the corners of the other side of the frame into, by providing magnetic latch means, by the use of overlapping adhesive labels, or by sealing the two covers together by known means, such as with radio frequency or ultrasonic plastic sealing techniques, or the use of adhesives to hold the free edges together.

The illustrations depict a plug 5 and socket 6 type of locking mechanism, but any suitable locking mechanism would be acceptable. In addition, the location of the locking mechanism can vary. For example, the locking mechanism can be located in the corners of the flanges, in order to not interfere with the contents of the container. As another example, a magnetic locking mechanism, with magnets imbedded in the flanges, could also be used.

The container can be formed of a single, semi-rigid sheet of film, which when folded or molded to form the flanges and frame borders, provides sufficient structural rigidity to protect the material within the container. Thus the flanges provide not only the additional use of a frame border, but also provide the added structural rigidity which may be needed for the container. Examples of suitable sheet material include unplasticized polyvinylchloride, lightly plasticized polyvinylchloride, styrene, polypropylene, PET, and PETG, or any other vacuum-formable plastic, or forming from injection-moldable plastic, or non-thermoplastic material, including paperboard, having sufficient flexibility to be folded and yet be sufficiently rigid in sheet form when formed with the flanges, to protect the contents of the package. Such polymers are sold, e.g., by Hoechst Chemical, or by Primex Plastic, or by Goodyear Chemicals.

The product of this invention can also be injection molded using the living hinge concept.

When selecting sheet material to be used, the thickness of the sheet should be selected so that it can be readily shaped, as by folding or pressure-forming, but be sufficiently flexible so that the integral hinge folds remain sufficiently flexible to be easily opened or closed during use. Sheet material of the commonly used polymers or paperboard can be used, e.g., at a thickness in the range of from about 5 to about 50 mils, and more broadly from about 0.005 to about 0.5 in.

Figure 13:
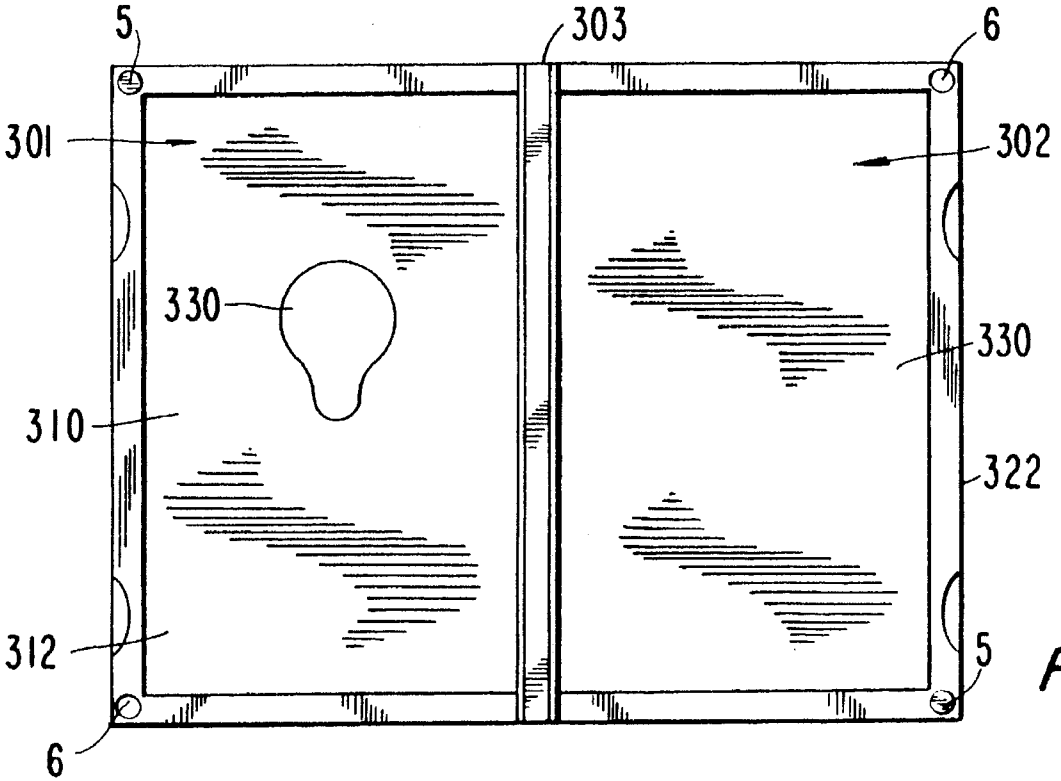
FIG. 13 illustrates another embodiment of the invention as in FIG. 2 with a blister imbedded in or through a portion of the outer surface of the first half of the invention.
Figure 15:
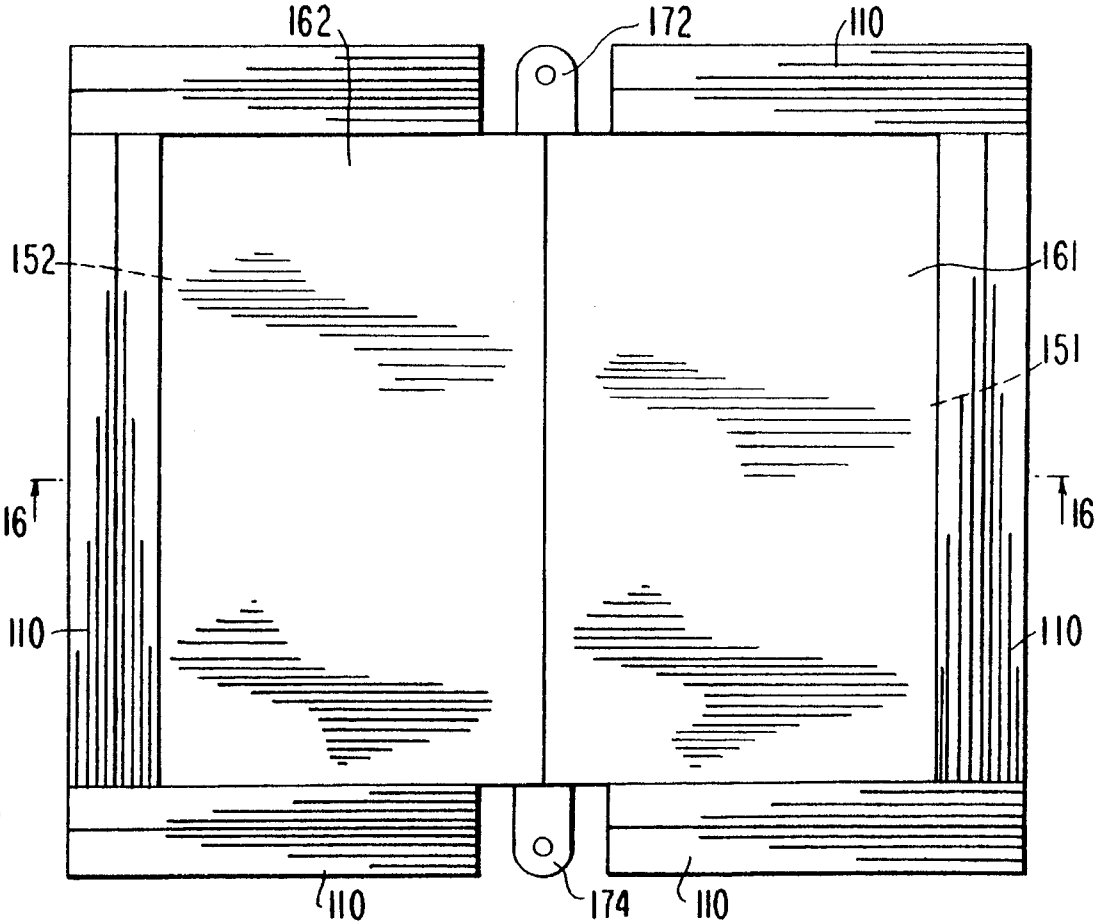
FIG. 15 shows a plan view of the folded blank of FIG. 14.
Figure 16:
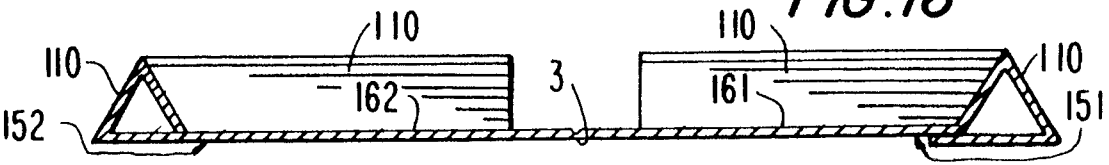
FIG. 16 shows a cross-section view of the folded blank of FIG. 14, taken along lines 16—16, of FIG. 15.

A blister 330, or other slightly protruding auxiliary container, can be attached to the outer surface(s) of the container or can be imbedded, as in FIG. 13, in the container surface. The contents of the container can comprise a mounting sheet for clip art and the clip art itself, and the auxiliary container, or blister, can contain, e.g., a pair of scissors and a tube of glue. Alternatively, any of these items can be held in place with a flange on the blister. The auxiliary container can be a thermoformed blister, of a thermoformed resin, or a paperboard envelope, for example.

Furthermore, the container can be formed of a sufficient size to contain any object for shipping or storage. It is only necessary that the size of the object be small relative to the space of the container. In particular, the container can contain any objects suitable for framing in the frame into which the container can be converted when the container is unfolded about the hinge. For example, the pieces of a jigsaw puzzle, and also clip art which can be adhesively or otherwise attached to the jig-saw puzzle pieces, either before or after assembly, can be secured within the container.

As shown in FIGS. 1–5, a flange can be formed along the top and bottom of the hinge center 3, as a portion of the frame border. Alternatively, as shown by FIGS. 7–10, a gap may exist when the frame is formed. This may be insignificant, depending on the material being framed. Alternatively, a significantly large gap in the framing border, i.e., the gap 4 overlying the central hinge area 3, can be filled with an appropriate adapter plug 9, if it is desired to create a continuous framing border. Such an adapter plug also provides a locking effect to prevent folding of the container out of the frame condition. Such adapters can be stored in place in, e.g., the concavity beneath the framing borders 236,246, and be placed into position to fill a gap, as desired.

The embodiments of FIGS. 14–17, can advantageously be formed of non-thermoplastic sheet material, such as paperboard, or other semi-rigid material. In addition to being formed from a single sheet, two sheets can be adhesively secured together to form the equivalent of a single sheet, or the two covers can otherwise be snapped or held together along at least two opposing edges.

What is claimed is:

1. A container for containing materials when in a closed condition and convertible to a frame for displaying such materials when the container is opened and the materials removed therefrom, the container comprising:

a. first cover means having a first inner container surface and a first outer mat supporting surface, first, second, third and fourth edges defining a rectangle therebetween;

b. second cover means having a second inner container surface and a second outer mat supporting surface, fifth, sixth, seventh and eighth edges defining a rectangle therebetween;

c. said first cover means and said second cover means being formed integrally with a hinge means joining said first edge of said first cover means to said seventh edge of said second cover means which permits said first cover means inner surface to be placed adjacent said second cover means inner surface;

d. said first cover means having a first closure surface on said first inner container surface adjacent said third edge opposite said first edge;

e. said second cover means having a second closure surface on said second inner container surface adjacent said fifth edge opposite said seventh edge;

f. said first cover means having first raised frame border means extending from and above said first outer mat supporting surface adjacent said second, third and fourth edges;

g. said second cover means having a second raised frame border means extending from and above said second outer mat supporting surface adjacent said eighth, fifth and sixth edges; and h. locking means in said first closure surface and said second closure surface which when engaged hold said first cover means and said second cover means closed about articles place between said first inner container surface and said second inner container surface; and when said locking means are not engaged permit said first cover means and said second cover means to be placed side by side wherein materials can be placed upon said first outer mat supporting surface and said second outer mat supporting surface within said first and second raised frame border means.

2. The container of claim 1 wherein said container is formed of a semi-rigid thermoplastic polymer material.

3. The container of claim 7 further comprising a relatively small blister molded into one of the outer surfaces.

4. The container of claim 1 wherein said container is formed by a process comprising molding a semi-rigid thermoplastic polymer material.

5. The container of claim 1 formed of paperboard.

6. A container as defined in claim 1, wherein at least one of said first and second cover means has stop means adjacent its edge opposite the edge coupled to said hinge to prevent materials from exiting said container when said first cover means and said second cover means are locked together.

7. A container as defined in claim 1, further comprising an auxiliary container secured to one of said first and second cover means.

* * * * *